United States Patent [19]

Wolfe et al.

[11] Patent Number: 4,590,622

[45] Date of Patent: May 27, 1986

[54] SHOULDER, CHEST AND NECK PROTECTING DEVICE

[75] Inventors: Robert A. Wolfe, Amherst; Gleisner, Donald, Lorain, both of Ohio

[73] Assignee: All American Inc., Elyria, Ohio

[21] Appl. No.: 756,443

[22] Filed: Jul. 18, 1985

[51] Int. Cl.[4] ..... A41D 13/00

[52] U.S. Cl. ..... 2/2; 2/DIG. 6

[58] Field of Search ..... 2/2, 268, DIG. 6

[56] References Cited

U.S. PATENT DOCUMENTS

| | | | |
|---|---|---|---|
| 653,544 | 7/1900 | Burns et al. | 2/2 |
| 1,489,048 | 4/1924 | Whitley | 2/2 |
| 3,528,106 | 9/1970 | Austin | 2/2 |
| 4,295,227 | 10/1981 | Mitchell | 2/2 |
| 4,501,023 | 2/1985 | Bilberry | 2/2 |
| 4,554,681 | 11/1985 | Kirkland | 2/2 |

*Primary Examiner*—Werner H. Schroeder
*Assistant Examiner*—Andrew M. Falik
*Attorney, Agent, or Firm*—Gustalo Nunez

[57] ABSTRACT

A protective gear assembly includes cantilever-type protective pads to be used by those athletes engaged in contact sports such as football, hockey, etc. The pads are releasably attached to a one piece padded vest type jacket by strap like members which pass through apertures thereon. The vest jacket is designed to receive all the necessary elements in the protective gear assembly such as epaulettes, padded cups, back plates shoulder plates and breast plates.

3 Claims, 6 Drawing Figures

SHOULDER, CHEST AND NECK PROTECTING DEVICE

BACKGROUND OF THE INVENTION

1. Field of the Invention

This invention relates to athletic apparel and more particularly to an improved shoulder pad device for football players and other atheletes involved in contact sports that will afford protection for the shoulders, collar bone, biceps, sternum, ribs, clavicle, pectoral muscles, lateral aspects of the scapula and the humerous bone. Also, the invention contemplated herein is not bulky, is not cumbersome, but is lightweight and capable of receiving high intensity blows without breaking and also capable of absorbing a major portion of the energy created by the blow and distributing this energy over a wide area, thus protecting the football player from injury. Further, the football shoulder pad device contemplated herein is assembled without the use of even one rivet. Any element comprising the shoulder pad may be removed from the completed assembly simply by the disengagement of a Velcro strap, no special tools are needed. Elements may be added to the assembly as needed depending on the requirements of the user.

Further, the invention contemplated herein does not limit the body movements of the player, thereby permitting this invention to be used by linemen, backfield men, and quarterbacks. Each player on the team requires a certain kind of protection because of his position, e.g. linemen, and some less, e.g. quarterbacks. The ease with which the shoulder pads can be assembled, since there are no rivets nor screws used, enables the shoulder pad assembly to be assembled for the player depending on his position. In fact, to carry this premise to the extreme, the shoulder pads contemplated here can be repaired, assembled or modified during a ball game, quickly and efficiently.

2. Description of the Prior Art

The prior art is replete with shoulder pads and the like. For example, back in 1900, U.S. Pat. No. 653,544 discloses a shoulder pad comprising two halves formed out of heavy leather. Generally speaking, all shoulder pads have the same construction, i.e., they are formed of two half sections that are rigid or semi-rigid tied together at the back and at the chest. Also attached to the inside surface of the two half sections will be some kind of padding which is usually stitched or riveted to the half sections. From 1900 to the present, improvements have been made to the shoulder pads by the addition of additional shoulder cups, rib protection, hip protection and improved armor type materials and padding. The shoulder pads manufactured are held together by rivets or other similar type retaining means. Modern type shoulder pads are usually the cantilever type shoulder pads which allow the player increased mobility without loss of protection.

Not only is it important to provide a shoulder pad that gives the player the ultimate in protection and mobility, but it is also important to the entity that provides the shoulder pads and other equipment that the shoulder pads be economical in price and easy to maintain. All of the prior art shoulder pads require dozens of rivets in the manufacture of same. This makes the manufacture of the shoulder pads very costly. Also, in order to make repairs to the shoulder pads, it is necessary to have special tools in order to remove the rivets and make the necessary repairs.

Looking at 1981 U.S. Pat. No. 4,295,227, which discloses a modern day shoulder pad, it can be seen that it is constructed of a multiplicity of members, moveable and non-moveable. It is held together by rivets and/or straps which in turn are affixed to the armor material with rivets.

The present invention provides a great improvement over the prior art by providing an improved shoulder pad which is economical to manufacture, simple to repair without any tools, easy and comfortable to wear, and which is, to a great extent, lighter in weight compared to the prior art devices. The present invention is an improved shoulder pad completely assembled without the need of any mechanical fasteners.

SUMMARY OF THE INVENTION

The complications described in the prior art are overcome by the present invention, i.e., it is no longer necessary to manufacture shoulder pads using mechanical fasteners such as rivets. The padding utilized herein provides a more complete protection than the prior art. In the prior art, protection is provided by assembling a shoulder pad utilizing hard surface materials to which are riveted padded materials. Once the shoulder pad is assembled, it cannot be disassembled or repaired without the use of special tools. Also, since the assembly is more or less permanent, cleaning the shoulder pad assembly is cumbersome and expensive.

The present invention, an improved shoulder pad, is assembled about a vest-like padded jacket which is only open at the front. It is not necessary to tie the back portions together since the back portion is now an integral unit. The vest jacket is adapted to receive all the necessary elements which may be epaulettes, padded cups, back plates, shoulder plates, and breast plates necessary to make a complete assembly.

As in all shoulder pads, there are two U-shaped members which form a good part of the shoulder pad assembly and, as the prior art teaches, padding is stitched to the U-shaped members. In this invention, the U-shaped members are simply fit over the padded vest jacket and held there by straps which in this instance are equipped with opposing strips of VELCRO® material, a fastener which is very easy to work with. All the other elements which make up the rest of the shoulder pad assembly are then affixed to the combination of the two U-shaped members and the vest jacket. It can therefore can be seen that the present invention offers a novel shoulder pad which is very easily assembled and which offers increased body protection.

DESCRIPTION OF THE PREFERRED EMBODIMENT

Figure 1:
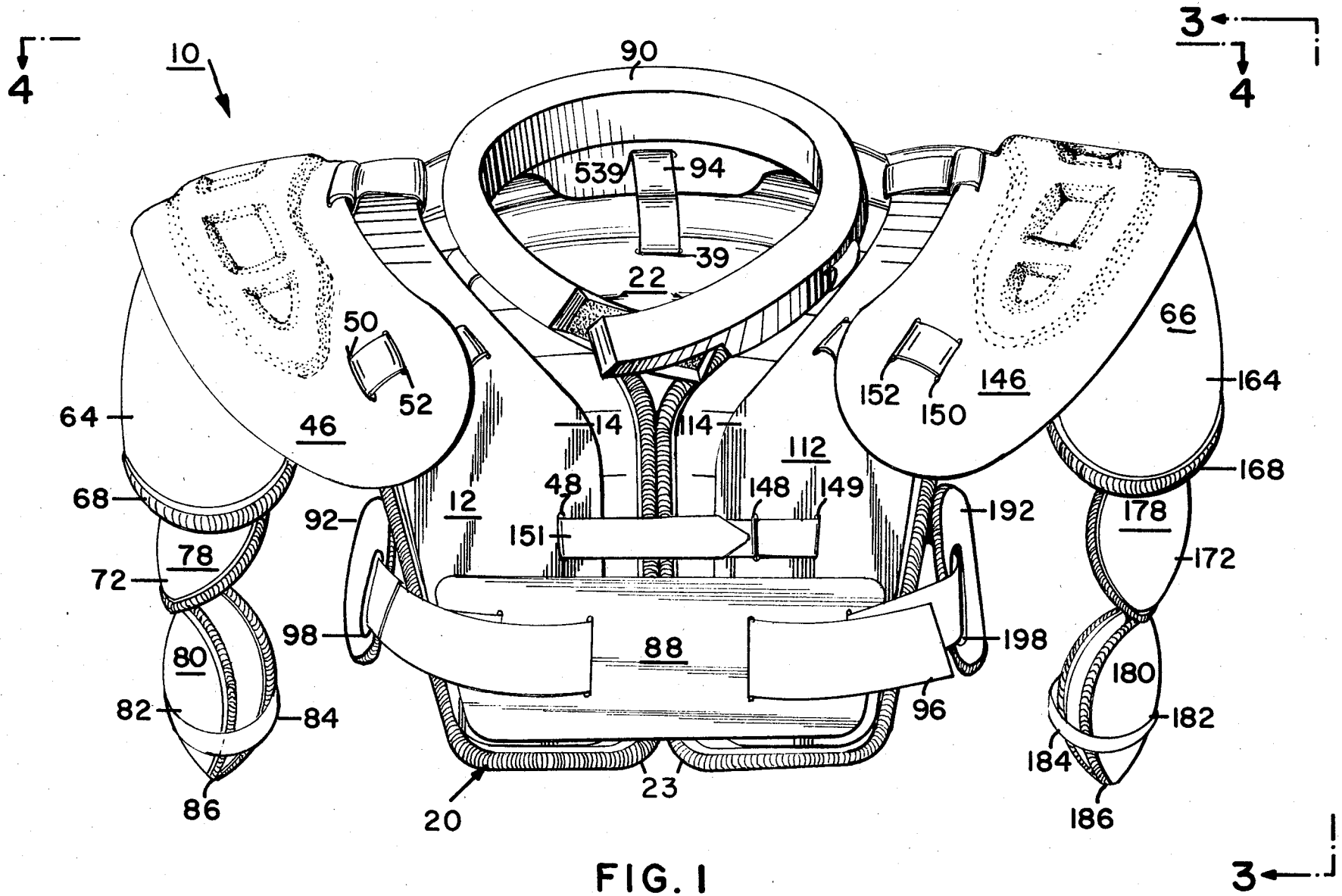
FIG. 1 is a front elevation view of the improved shoulder pad.
Figure 5:
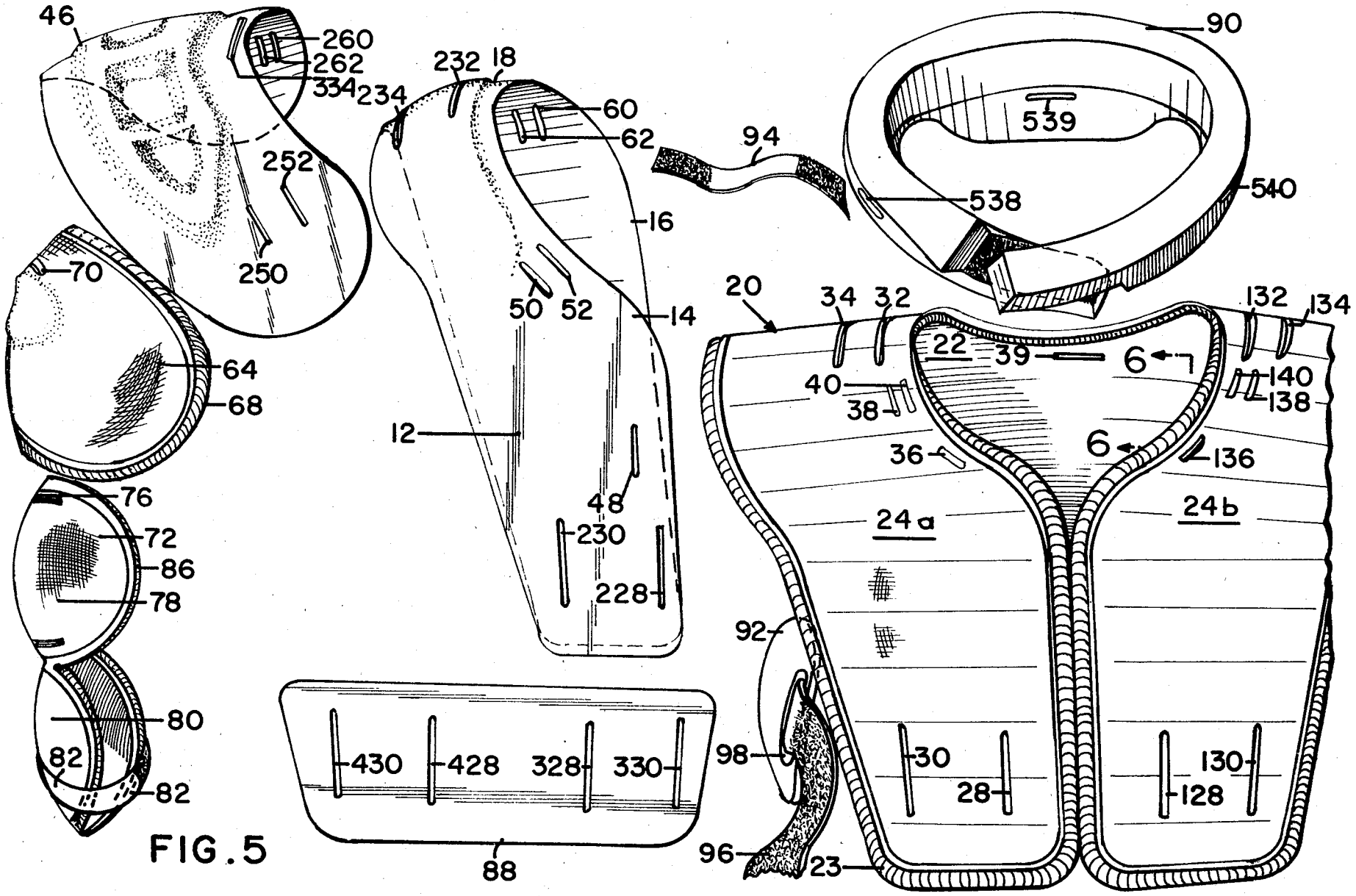
FIG. 5 is a disassembled partial view of the improved shoulder pad.

Referring initially to FIG. 1, the improved shoulder pad is indicated generally at 10. Referring now to FIGS. 1 and 5, the construction of the invention can better be understood. FIG. 5 illustrates the invention in an unassembled condition. The invention includes a semi-rigid right-handed member generally indicated at 12 which fits over the right shoulder and a semi-rigid left-handed member 112 which fits over the left shoulder. The members 12 and 112 are U-shaped in design as viewed from the side and member 12 consists of a chest plate 14, backplate 16 and an arch 18. U-shaped member 112 consists of a chest plate 114, backplate 116 and an arch 118. The arches 18 and 118, when the shoulder pad 10 is completely assembled, provide an opening for the wearer of the shoulder pad 10. The arches 18 and 118 are spaced such that an opening is provided for the neck of the wearer and with the spacing such that the arches 18 and 118 are adjacent and relatively close to the neck. The U-shaped member 12 is provided with openings or apertures 48, 50, 52, 60, 62, 228, 230, 232 and 234. Similarly, U-shaped member 112 is provided with identical apertures. As mentioned previously, U-shaped member 112 is identical to U-shaped member 12. Simply put, U-shaped member 12 is for the right shoulder and U-shaped member 112 is for the left shoulder.

Figure 2:
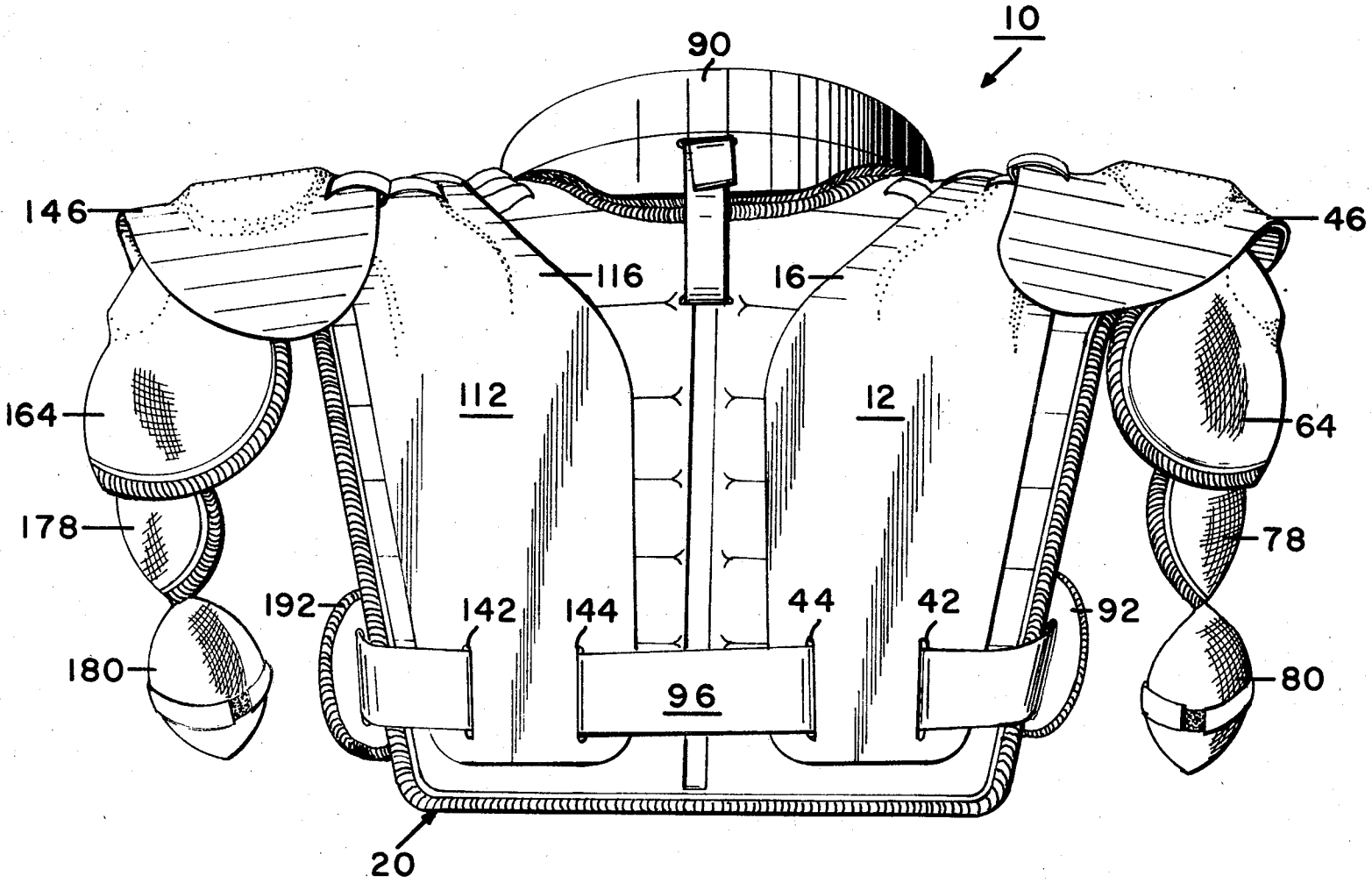
FIG. 2 is a back elevation view of the improved shoulder pad.
Figure 3:
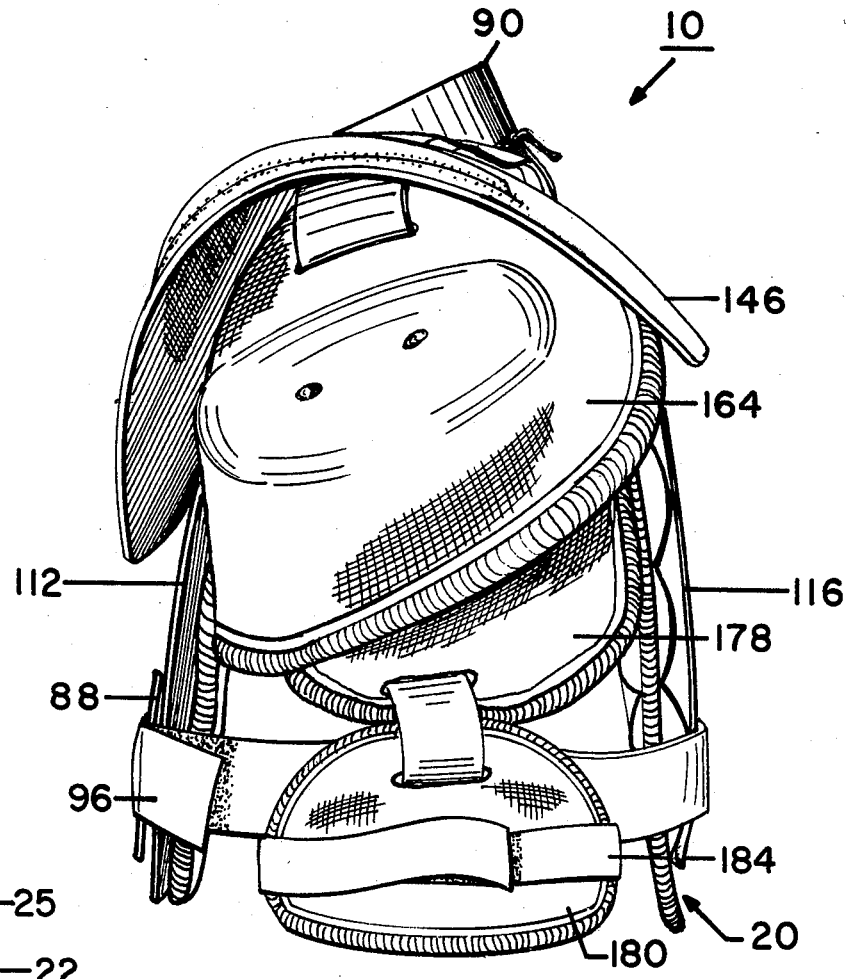
FIG. 3 is a side elevation view of the improved shoulder pad, taken at line 3—3 of FIG. 1.
Figure 6:
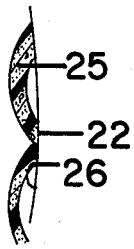
FIG. 6 is a partial cross-sectional view of the shoulder pad taken at line 6—6 of FIG. 5.
Figure 4:
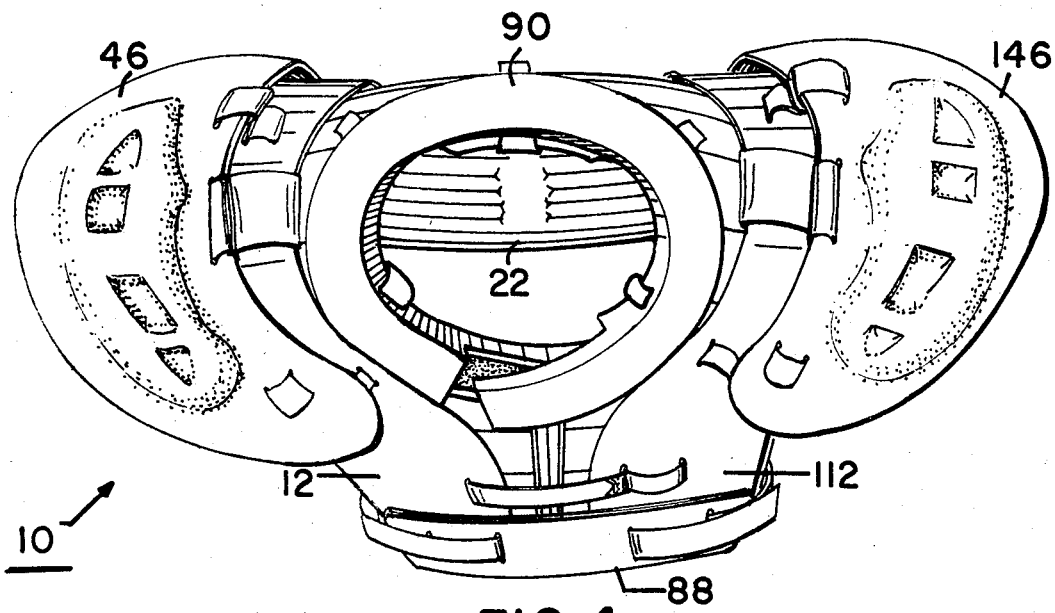
FIG. 4 is a top elevation view of the improved shoulder pad taken along line 4—4 of FIG. 1.

A vest-type jacket member 20 having an interior surface 22 and front portion **24*a* and 24*b*. The configuration of the jacket 20 is that of a sleeveless vest without buttons. The inside surface 22 of the jacket 20 is a padded material comprised of a plurality of swells 25 which form a plurality of elongated air pockets 26 throughout the jacket 20. The swells 25 which are really air cushions for distributing a force or blow applied to the jacket 20. The jacket 20 is provided with elongated openings on the chest portion 24*a* and 24*b* at 28, 30, 128 and 130. Other elongated openings or elongated apertures are provided on the shoulder portion of the jacket 20 at 32, 34, 132 and 134. Again referring to the upper front portion of the jacket 20, there are provided elongated openings at 36, 136, 38, 40, 138 and 140. Located on the interior surface 22 there is provided an elongated opening 39. The padding may comprise closed cell elastomeric vinyl foam in a stretch fabric cover. The vest jacket is provided with reinforced stitch ribbing 23 at all exterior edges. Referring now to FIG. 2, the back section of the jacket 20 is provided with openings at 42, 44, 142 and 144**.

Referring to FIG. 5 there is disclosed a right shoulder epaulette 46 or floppet as it is sometimes referred to. The floppet 146 for the left shoulder is identical to the right shoulder cap 46. The right shoulder epaulette 46 is provided with apertures at 250, 252, 260 and 334. Apertures are provided on the left shoulder epaulette 146 which are identical to those on the right shoulder epaulette 46. The reason for the apertures will soon become apparent.

There is also provided a right outer shoulder pad 64 and left outer shoulder pad 66. Members 64 and 66 are preformed padded cloth members with an interior configuration complementary to the contours of a human shoulder and are also designed to absorb all exterior forces and blows delivered to the shoulder. The members 64 and 66 are provided with reinforced stitch ribbing 68 at all exterior edges. Shoulder member 64 is provided with an aperture 70, shoulder member 164 is also provided with a similar aperture but is not shown. For purposes of brevity only a detailed description of the right side member 12 is being provided since the construction and assembly of the left side member 112 is identical to that of the right side member 12.

The shoulder pad assembly 10 is further provided with a pair of right and left outer shoulder and bicep pad members 72 and 172. The outer shoulder pad 72 is provided with an aperture 76. Likewise, outer shoulder pad member 172 is provided with an aperture, but is not shown on the drawings. The outer shoulder pad members 72 and 172 consist of two integral parts 78 and 80 and 178 and 180 respectively. Members 78 and 178 have a cup-like configuration and are designed to fit the shoulders. Members 80 and 180 are flexible in design and on the outside surface at 82 and 182 there is provided a VELCRO® surface fastening material on members 80 and 180. The strap 84 and 184 is also provided with VELCRO® fastening material and holds the member 72 and 172 onto the right and left arm respectively of the player. Member 72 and 172 is also provided with a reinforced ribbing 86 and 186 at all exterior edges.

Also shown on FIG. 5 is a semi-rigid chest plate member 88 having apertures 330, 328, 428 and 430. Another member comprising a part of the improved shoulder pad is a neckroll 90 provided with apertures 538, 539 and 540. The neckroll 90 is provided at its terminating ends with well-known fastening means VELCRO® such that the neckroll can be adjusted to the wearer's satisfaction. Yet another element of the improved shoulder pad are padded right and left rib protection member 92 and 192.

All of the elements and members of the improved shoulder pad have now been described and assembly of the elements and members will now be illustrated. The assembly of the shoulder pad 10 is done with the use of straps such as the strap shown at 94 in FIG. 5. All the straps used in the assembly are furnished with the well-known fastening means VELCRO®. The length and width of the straps to be used are dictated by where and how they are being utilized.

It is again emphasized that only the assembly of the right side member 12 will be described since the left hand assembly is identical. Shoulder bicep member 72 is connected to the right side U-shaped member 12 by looping a VELCRO® equipped strap through the aperture 232 and up and around the edge of the arch 18 and through aperture 76 and finally closing upon itself. Naturally, the adjustment is determined by the size of the individual. Outer shoulder member 64 is affixed to the right side member 12 by running a VELCRO® equipped strap through aperture 70, 232 and 234, and finally closing upon itself. Right shoulder cap member 46 is affixed to U-shaped right side member 12 by running a VELCRO® equipped strap through apertures 232, 234 and 334. For added strength, cap member 46 is also attached to U-shaped right side member 12 by running a VELCRO® equipped strap through apertures 50, 52, 250 and 252, and finally closing upon itself, and through apertures 60, 62, 260 and 262, and finally closing upon itself. Right hand member 12 fits over the jacket portion **24*a* and is connected thereto by running a VELCRO® equipped strap through apertures 32 and 34. Any of the straps used to connect member 46, 64 or 72 may be used for this purpose. No extra strap is necessary; however, the strap connecting member 62** is the preferable one to use.

The shoulder pad 10 is also provided with a neckroll 90 which can be worn around a player's neck to reduce injuries. The possibility of neck injuries is due primarily to extreme flexing of the cervical spine and because of exterior blows which may be directed to a player's neck. The neckroll 90 is connected to the shoulder pad 10 by looping straps, having VELRO® fasteners, through apertures 38, 40 and 538, 39 and 539, 138, 140 and 540. All the straps close upon themselves. The terminating ends of the neckroll 90 are provided with VELCRO® fasteners and thus can be adjusted to whatever size the player wants. The neckroll 90 may be a shaped roll of sponge rubber and serves as a restraint, i.e., it prevents the flexing or stretching of the neck beyond a predetermined position thus reducing the possibility of neck injuries. The neckroll 90 may also be used for training purposes and is easily removed.

The improved shoulder pad 10 is also provided with a semi-rigid plastic chest plate 88 which offers additional frontal protection to the players. A strap 96 provided with VELCRO® fasteners is looped through the apertures 42, 44, 142 and 144 located at the back portion of members 12 and 112. The strap 96 is then looped through the apertures 98 and 198 located on the right and left rib protection members 92 and 192 respectively. Now coming to the frontal portion the terminating end of strap 96, which is looped through aperture 98, is inserted into the aperture 430, 230 and 30 and looped through aperture 28, 228 and 428. The strap 96 is then looped back on itself becoming locked in place because of the VELCRO® fasteners on said strap. The left side of the strap 96 is similarly connected.

U-shaped right hand member 12 is provided with an aperture 48 and left hand member 112 is provided with apertures 148 and 149 (see FIG. 1). In the final assembly of the shoulder pad 10, the top portion of right hand member 12 and left hand member 112 is held together by looping a strap 151 through apertures 48, 148 and 149, said strap 151 being equipped with VELCRO® fastening means.

Epaulette members 46 and 146, U-shaped members 12 and 112, and chest plate member 88 are all a dense semi-rigid type material such as a light-weight molded plastic. One material could be a high density polyethylene, which provides high impact resistance to blows. The padding used in members 64, 164, 72, 172, 80 and 180, and on the interior surface of the jacket member 20, may be an elastomeric vinyl foam which may be covered by a stretch knit fabric. The padding may also be formed from closed cell vinyl rubber. These types of padding have the ability to absorb most of the energy delivered by blows thus offering enhanced protection to the player.

The shoulder pad 10 described herein, because of its inherent construction, may have any number of pads, caps, or epaulettes added very simply because no rivets or stitching of any kind are required in the construction, and assembly. The prior art shoulder pads all use stitching or riveting or both in their construction. The shoulder pad 10 described does not require such type of construction. The entire assembly is performed with straps thus obviating the need for any special type of tooling. Further, the shoulder pad 10 can be easily modified for any player depending on his position. Also, the shoulder pad 10 can be easily repaired right on the field in a relatively short period of time. The vest member 24 described herein, because of its inherent design, provides more protection for the shoulder blades and provides extra frontal protection. It is again noted that all prior art devices require the padding material to be stitched or riveted to the plastic shell. Also, it can be seen that none of the plastic material used here can come in contact with the user's body.

Thus, although a preferred embodiment of the shoulder pad has been disclosed and described in detail herein, it should be understood that this invention is in no sense limited thereby and its scope is to be determined by the appended claims.

Having thus described the invention, what is claimed is:

1. A protective pad assembly comprising:

a vest type member having chest, back and shoulder portions, a plurality of apertures located on said right and left chest portions, back and shoulder portions, said vest further including an inside surface of padded material, a semi-resilient U-shaped left hand member adapted to fit over the left side of said vest member, a semi-resilient U-shaped right hand member adapted to fit over the right side of said vest member, means for removeably attaching said right and left hand members to said vest member, semi-resilient right and left epaulettes having a plurality of apertures located thereon and means removeably hingedly attaching said right and left epaulettes to said right and left vest members, a right hand and left hand padded cap member convex in form and adapted to fit within said right and left epaulettes, said right hand and left hand cap members having an aperture located thereon and means for removeably hingedly attaching said right hand and left hand cap members to said right and left vest members, a pair of right and left rib protector pads, a semi-resilient chest plate member, having a plurality of apertures thereon, means for supporting said rib protector pads and said chest plate to said right and left U-shaped members, said apertures described herein cooperating with said attaching means described herein throughout said shoulder pad assembly.

2. A rivetless protective pad assembly comprising:

a padded vest member having chest, back and shoulder portions for left and right sides and including a plurality of apertures on said chest, back and shoulder portions, left and right semi-rigid U-shaped members adapted to snugly fit over the left and right sides of said vest member, said U-shaped members having a plurality of apertures thereon, said apertures being complementary to certain apertures on said vest member and including removeable connecting means for connecting said U-shaped members to said vest, said connecting means utilizing said apertures, left and right semi-rigid epaulettes, convex in configuration and having a plurality of apertures on one end thereof, means for connecting said left and right epaulettes utilizing said apertures and the apertures located on said left and right U-shaped members, left and right resiliently padded caps, said caps having at least one aperture thereon, means for connecting said left and right padded caps to said left and right U-shaped members utilizing at least one said aperture and the apertures located on said left and right U-shaped members, left and right semi-rigid shoulder and bicep protector pads all being one integral unit and said shoulder protector pad being convex in configuration and said bicep protector pad being curvilinear in configuration, said portion of said left and right protector pads having at least one aperture thereon, means for connecting said left and right shoulder protector pads too said left and right U-shaped members by utilizing at least on aperture on said left and right protector pads and the apertures located on said left and U-shaped member, a semi-rigid plate member having a plurality of apertures thereon, said apertures complementary to certain said apertures located on the chest portion of said left and right U-shaped member, means for connecting said plate member utilizing apertures on said plate member to said left and right U-shaped members, left and right rib protector members and means for connecting said rib protector members to said chest portions of said left and right U-shaped member when said shoulder pad is fitted on an individual.

3. A rivetless protective pad assembly comprising:

a padded vest member having left and right side, chest, back and shoulder portions including a plurality of apertures on said chest, back and shoulder portions, left and right semi-rigid U-shaped members adapted to snugly fit over the left and right sides of said vest member, said U-shaped members having a plurality of apertures thereon, said apertures being complementary to certain apertures on said vest member and including removeable connecting means for connecting said U-shaped members to said vest, said connecting means utilizing said apertures, left and right semi-rigid epaulettes, convex in configuration and having a plurality of apertures on one end thereof, means for connecting said left and right epaulettes utilizing said apertures and the apertures located on said left and right U-shaped members, left and right resiliently padded caps, said caps having at least one aperture thereon, means for connecting said left and right padded caps utilizing at least one said aperture and the apertures located on said left and right U-shaped members, left and right semi-rigid shoulder and bicep protector pads all being one integral unit and said shoulder protector pad being convex in configuration and said bicep protector pad being curvilinear in configuration, said portion of said left and right protector pads having at least one aperture thereon, means for connecting said left and right shoulder protector pads to said left and right U-shaped members by utilizing at least one aperture on said left and right protector pads and the apertures located on said left and U-shaped members, a semi-rigid plate member having a plurality of apertures thereon, said apertures complementary to certain said apertures located on the chest portion of said left and right U-shaped member, means for connecting said plate member to said left and right U-shaped member utilizing apertures on said plate member and said left and right U-shaped member, means for connecting said shoulder portions member to said chest portions of said left and right U-shaped member when said shoulder pad is fitted on an individual and a neckroll with means for attaching said neckroll to said left and right semi-rigid U-shaped members.

* * * * *